US008183175B2

(12) United States Patent
Masuda

(10) Patent No.: US 8,183,175 B2
(45) Date of Patent: May 22, 2012

(54) THERMAL RECORDING MATERIAL

(75) Inventor: Takao Masuda, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 598 days.

(21) Appl. No.: 12/311,127

(22) PCT Filed: Sep. 18, 2007

(86) PCT No.: PCT/JP2007/068599

§ 371 (c)(1),
(2), (4) Date: Mar. 19, 2009

(87) PCT Pub. No.: WO2008/035798

PCT Pub. Date: Mar. 27, 2008

(65) Prior Publication Data

US 2010/0062195 A1 Mar. 11, 2010

(30) Foreign Application Priority Data

Sep. 19, 2006 (JP) ..... 2006-253476

(51) Int. Cl.
*B41M 5/42* (2006.01)
*B41M 3/12* (2006.01)

(52) U.S. Cl. ..... 503/226; 427/152

(58) Field of Classification Search ..... None
See application file for complete search history.

(56) References Cited

U.S. PATENT DOCUMENTS

| | | | | |
|---|---|---|---|---|
| 4,246,312 | A | 1/1981 | Kosaka et al. | |
| 6,017,848 | A * | 1/2000 | Mando et al. | 503/226 |
| 6,071,851 | A | 6/2000 | Wakamatsu | |
| 6,258,747 | B1 | 7/2001 | Midorikawa et al. | |
| 7,049,267 | B2 * | 5/2006 | Wagner et al. | 503/200 |

FOREIGN PATENT DOCUMENTS

| | | |
|---|---|---|
| JP | 59-5093 | 1/1984 |
| JP | 59-155097 | 9/1984 |
| JP | 62-5886 | 1/1987 |
| JP | 1-125278 | 5/1989 |
| JP | 9-267555 | 10/1997 |
| JP | 10-217608 | 8/1998 |
| JP | 10-250237 | 9/1998 |
| JP | 2000-79758 | 3/2000 |
| WO | 98/06589 | 2/1998 |

OTHER PUBLICATIONS

International Search Report dated Nov. 13, 2007 in the International (PCT) Application PCT/JP2007/068599 of which the present application is the U.S. National Stage.

PCT Written Opinion dated Nov. 13, 2007 in the International (PCT) Application PCT/JP2007/068599 of which the present application is the U.S. National Stage.

* cited by examiner

*Primary Examiner* — Bruce H Hess

(74) *Attorney, Agent, or Firm* — Wenderoth, Lind & Ponack, L.L.P.

(57) ABSTRACT

In a thermal recording material having an intermediate layer and a thermal recording layer that are laminated on a support in this order, the above intermediate layer contains a swellable starch and a pigment and is formed by applying onto the support a coating liquid containing the swellable starch and the pigment in the state of being dispersed in a dispersing medium composed of water as a main component, whereby a number of voids are formed in the intermediate layer and there can be provided a thermal recording material excellent in thermal response and head-matching property.

16 Claims, 1 Drawing Sheet

THERMAL RECORDING MATERIAL

TECHNICAL FIELD

This invention relates to a thermal recording material, and in particular, it relates to a thermal recording material excellent in thermal response, printed image quality and head-matching property.

BACKGROUND ART

Generally, a thermal recording material has a substrate and a heat-sensitive recording layer that is formed thereon and that contains, as main components, a generally colorless or light-colored electron-donating dye precursor and an electron-accepting compound. When the thermal recording material is heated with a thermal head, a hot pen, a laser beam, etc., the electron-donating dye precursor and the electron-accepting compound readily react with each other to give a recorded image. Such thermal recording materials are used in broad fields of measuring recorders, facsimile machines, printers, computer terminals, labeling machines, automatic vending machines of railway tickets or other tickets, and the like, owing to advantages that recordings are made with so simple apparatus, their maintenance is easy and they make no noise. In recent years in particular, thermal recording materials have come to be used for receipts of gas rates, water rates, electric rates, etc., slips, various receipts, etc., of ATMs of banking facilities, recording papers of financial affairs, thermal recording labels for POS systems, thermal recording tags, etc.

As the use fields thereof become so diversified, there are demanded thermal recording materials that are highly sensitive and free of ground fogging and, further, that exhibit the adherence of less deposit to a thermal head and are excellent in thermal head-matching property.

In general, the electron-donating dye precursor and the electron-accepting compound as thermal recording components for a thermal recording material are often used in the form of dispersed particles. For achieving higher sensitivity, it is sufficient to use them after they are pulverized into particles that are as fine as possible. However, when they are pulverized into particles that are too fine for achieving ultra-high sensitivity, the coloring sensitivity is improved, but the ground fogging is intensified, so that the dispersing of them has its own limit.

Therefore, there has been developed a method in which a heat-insulating intermediate layer containing a pigment is formed between the support and thermal layer of a thermal recording material in order to achieve higher sensitivity. For example, there is disclosed a method in which an oil-absorbing pigment is incorporated into an intermediate layer (for example, see JP59-155097A). Further, there are disclosed a method in which hollow particles to be obtained by expanding are incorporated into an intermediate layer (for example, see JP59-5093A), a method in which non-expandable hollow particles are incorporated into an intermediate layer (for example, see JP62-5886A) and a method in which cup-shaped particles each having an opening portion are incorporated into an intermediate layer (for example, see JP10-217608A).

When these heat-insulating intermediate layers are formed, thermal recording materials are improved in thermal response and improved in printed image quality. However, in the method in which an oil-absorbing inorganic/organic pigment is incorporated into an intermediate layer, the properties of oil absorption and heat insulation are generally materialized by the porous structure of the pigment, and yet it has porosity (high specific surface area). Therefore, when a water-soluble adhesive is used, it is required to use a large amount of the adhesive for imparting sufficient strength that an adhesive layer should have. However, such a large amount of the adhesive impairs the porosity, and as a result, the intermediate layer is degraded in the property of heat insulation, and the improvement of the thermal response is inevitably limited. On the other hand, the method in which hollow particles are incorporated into an intermediate layer is free from a decrease by an adhesive in the property of heat insulation. Since, however, the particles per se have almost no property of oil absorption, the intermediate layer cannot absorb all of deposit that occurs from the thermal layer in printing on a thermal recording layer, and there is a problem that deposit left by the printing adheres to a thermal head to degrade the printed image quality.

DISCLOSURE OF THE INVENTION

It is an object of this invention to provide a thermal recording material having an intermediate layer and a thermal recording layer which are laminated on a support in this order, said thermal recording material having high thermal response and being excellent in printed image quality and head-matching property.

The present inventor has made diligent studies and as a result, has invented the thermal recording material of this invention that can achieve the above object. That is, the thermal recording material of this invention is a thermal recording material having an intermediate layer and a thermal recording layer that are laminated on a support in this order, wherein the above intermediate layer is a layer obtained by applying onto the support a coating liquid containing a swellable starch and a pigment in the state of being dispersed in a dispersing medium composed of water as a main component.

In a preferred embodiment of this invention, the swelling degree of the swellable starch is controlled by a crosslinked structure, and in another preferred embodiment, the swellable starch has a swelling degree of 2 or more and the swellable starch has a volume average particle diameter of 100 μm or less in the state of being swollen in water.

The starch that is swollen in water forms a layer together with a pigment in a drying step after the application onto the support. Water swelling the starch evaporates in the final stage of the drying, so that the swollen starch undergoes volume shrinkage due to the drying after the layer thickness is fixed. Therefore, the starch forms voids corresponding to the shrinkage in the layer. These voids impart the intermediate layer with the property of heat insulation and improve the thermal recording material in thermal response, and at the same time, the voids impart the intermediate layer with a head deposit absorbing function, so that it is improved in head-matching property. That is, when, for an intermediate layer, the swellable starch is applied onto the support together with a pigment in the state of being swollen, the intermediate layer can be imparted with the property of heat insulation and the property of absorbing head deposit. And, when a thermal recording layer is laminated thereon, there can be obtained a thermal recording material that has high thermal response and that is excellent in head-matching property.

In another preferred embodiment of this invention, the intermediate layer contains an oil-absorbing pigment. When the above swellable starch for an intermediate layer is applied onto the support together with an oil-absorbing inorganic pigment, the starch that is swollen in water has a size sufficiently large relative to the diameter of pores of the oil-absorbing inorganic pigment, so that it effectively works as an adhesive without filling up the pores and can impart the layer with sufficient strength. That is, the oil-absorbing property (head deposit absorption property) and heat-insulation property of the oil-absorbing inorganic pigment are not impaired, and further, the intermediate layer can be additionally imparted with voids/heat insulation property by the shrinking effect that the swellable starch produces when dried, so that the thermal recording material can be further improved in thermal response, printed image quality and head-matching property.

Further, in another preferred embodiment of this invention, the intermediate layer contains a heat-insulating organic pigment that has the form of hollow or cup-shaped particles. When the above swellable starch for an intermediate layer is applied on the support together with the hollow or cup-shaped heat-insulating organic pigment, the intermediate layer can be imparted with new voids due to a shrinking effect produced during drying, the heat-insulating property by the form of hollow/cup-shaped particles can be further improved, and at the same time, the thermal recording material can be imparted with the head deposit absorption property that the hollow/cup-shaped organic pigment does not have, so that the thermal recording material can be also improved in thermal response, printed image quality and head-matching property.

PREFERRED EMBODIMENTS OF THE INVENTION

Figure 1:
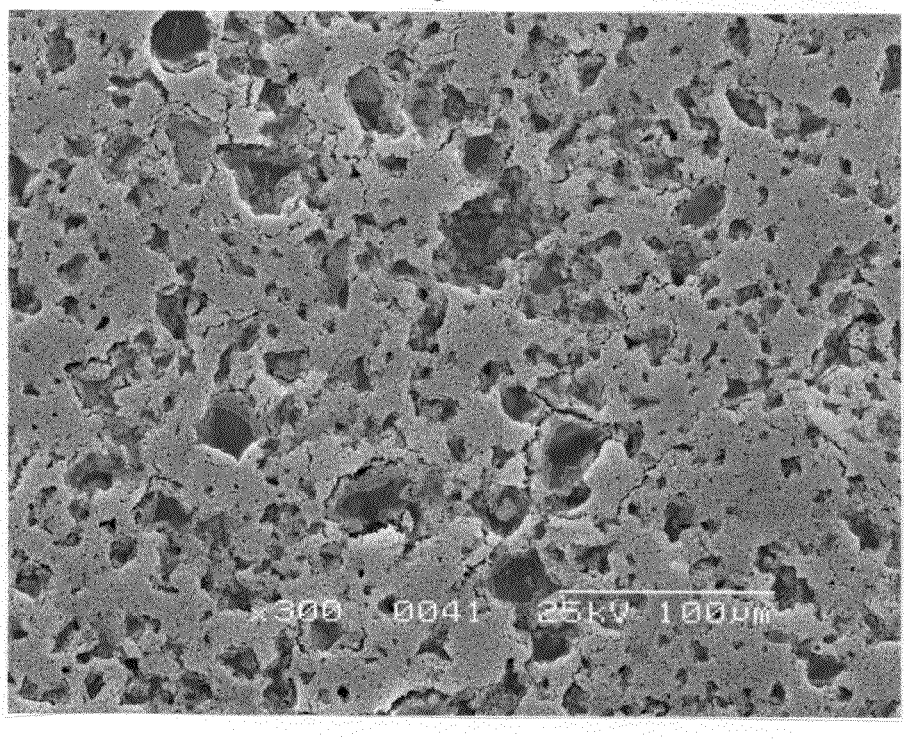
FIG. 1 is an electron microscope photograph of the surface of an intermediate layer in Example 3.

The content of this invention will be more specifically explained below. The thermal recording material of this invention has an intermediate layer and a thermal recording layer which are laminated on a support in this order. The content of this invention will be more specifically explained below.

The intermediate layer in this invention is formed by applying onto a support a coating liquid containing a swellable starch and an organic pigment in the state of being dispersed in a dispersing medium composed of water as a main component and drying an applied coating liquid. Generally, a thermal recording material is produced by applying thermal recording components in the state of a coating liquid for forming a thermal recording layer to a support and drying an applied coating liquid, and the main component of dispersing medium of the coating liquid is often water from the viewpoint of productivity and safety. The intermediate layer in this invention is also obtained by applying a coating liquid of a dispersing medium composed of water as a main component onto a support, and a conventional coating technique for thermal recording materials can be applied as it is, which is industrially advantageous in view of productivity.

When a swellable starch having the capability of swelling by means of water is applied onto a support in the state of being an aqueous coating liquid together with a pigment, the effect of this invention is achieved. This swellable starch shrinks from its swollen state in the process of drying after application and hence forms a number of voids in a pigment coating layer. The voids of this intermediate layer not only improve the layer in the property of heat insulation but also give the property of absorbing head deposit that occurs in a thermal recording layer during thermal printing, whereby there can be provided a thermal recording material that has high thermal response and is excellent in printed image quality and head-matching property.

In this invention, the swelling degree of the swellable starch is controlled to 2 or more, preferably in the range of 2 or more but 30 or less, more preferably in the range of 5 or more but 30 or less, whereby voids can be effectively formed in the intermediate layer and the thermal recording material can be imparted with the property of heat insulation and the property of head deposit absorption. When the swelling degree is less than 2, the volume ratio of swelling/shrinking of the starch is small, and as a result, voids formed in the layer are small, so that none of the property of sufficient heat insulation and the property of sufficient head deposit absorption can be attained. Although not specially limited from the viewpoint of the effect of this invention, the upper limit of the swelling degree is preferably 30 or less in view of dispersibility of a pigment. When the swelling degree is too large, the starch is liable to undergo aggregation and precipitation due to an interaction with a pigment in a co-dispersion, and the productivity may greatly decrease or voids formed during drying are liable to collapse.

The swelling degree as used in this invention is related to a volume expansion when the starch swells in water, and it is measured by the following method. A sample in a water-free amount of 2 g is added to 200 ml of pure water and dispersed therein, and immediately thereafter, it is heated in a well boiling hot bath for 30 minutes and cooled to room temperature. A portion of water that has evaporated is added, the sample is again dispersed and 100 ml of the dispersion is accurately placed in a graduated measuring cylinder. The graduated measuring cylinder is allowed to stand at room temperature for 24 hours and a precipitate is visually measured for an amount (ml) and this value is taken as a swelling degree.

The swellable starch in this invention is swollen in water and can be dispersed in the state of being particles, while the volume average particle diameter thereof in the state of being swollen in water is 100 μm or less, more preferably in the range of 0.1 μm or more but 100 μm or less. Further, it is particularly preferably 0.5 μm or more but 50 μm or less. The volume average particle diameter of the starch swollen in water in this invention is measured by a dynamic light-scattering method. In general thermal recording materials, the thickness of an intermediate layer is approximately 2 to 50 μm from the viewpoint of its effect and productivity. When the volume average particle diameter of the swollen starch is greater than 100 μm, therefore, there are formed voids that are too large relative to the thickness of the intermediate layer, and the roughness of a surface is too large, white spots occur in thermal printing, and the printed image quality is greatly degraded. On the other hand, the lower limit of the particle diameter is not limited, since the effect of this invention can be achieved so long as voids are effectively formed due to a size of a pigment that is contained together. However, when the particle diameter is extremely small as compared with a generally used pigment, the effect thereof is not exhibited, so that it is preferably 0.1 μm or more.

The swellable starch in this invention is a starch that is controlled and processed by any method with regard to its swelling degree in water and volume average particle diameter, and the method of processing the same is not specially limited.

Examples of the swellable starch include crosslinked starch, aged starch, wet- and heat-treated starch, emulsifier-treated starch, etc. Of these swellable starches, aged starch, wet- and heat-treated starch and emulsifier-treated starch can be properly adjusted with regard to their swelling degree, while the swelling degree is liable to vary, and soluble components may be sometimes contained. In this point, chemically crosslinked starch is more preferred since the swelling degree thereof can be easily adjusted depending upon a crosslinking degree (an amount of a crosslinking reagent) and since the variability of the swelling degree is small.

The crosslinked starch refers to a starch obtained by chemically bonding starch molecules with a difunctional or polyfunctional crosslinking reagent that chemically reacts with hydroxyl groups of the starch molecules to bond them. Although not specially limited, the reagent for the crosslinking reaction of the starch includes epichlorohydrin, phosphorus oxychloride, polyphosphate, metaphosphate, adipic acid, acrolein, etc. The amount of the difunctional or polyfunctional crosslinking reagent that can chemically react with hydroxy groups of starch molecules to bond them is not specially limited so long as the swelling degree is properly controlled. However, it is added in an amount of 0.1 to 5 mass % based on the starch as a raw material.

The swellable starch having a crosslinked structure is preferably ionized. When ionized, the swellable starch has hydrophilic nature increased, the swelling readily takes place and its handling becomes easy. When the swellable starch is ionized in a swollen state in water, an electrostatic reaction inhibits swellable starch particles from aggregating and inhibits swellable starch particles and pigment particles from aggregating, and a more stable pigment coating liquid can be prepared. Although not limited, the reagent as an ionizer for the starch includes 3-chloro-2-hydroxypropyltrimethylammonium chloride, 2,3-epoxypropyltrimethylammonium chloride, 3-chloro-2-hydroxypropyldimethyldodecylammonium chloride, 2-hydroxypropyldimethyloctadecylammonium chloride, sodium acetate monochloride, acetic anhydride, maleic anhydride, etc.

A starch having a volume average particle diameter of 0.1 μm or more but 100 μm or less in a swollen state is prepared by finely pulverizing a starch by an arbitrary method. The method for fine pulverization includes a method of (dry or wet) pulverization using a ball mill, a rod mill, etc., and a spray dry method. The order of the fine pulverization and the processing for swelling control is not specially limited so long as the swelling degree and the particle diameter during swelling are properly controlled, while the fine pulverization is preferably carried out after the processing for swelling control in view of productivity.

As a method for fine pulverization of the crosslinked starch, the following method is particularly preferably employed. The starch crosslinked by an arbitrary method is wet-treated by heating the crosslinked starch while applying shear force with an extruder under high pressure in a state where it has a water content of 30% or less. Then, the wet crosslinked starch is spray-ejected through fine nozzles having a proper form and an opening diameter each at room temperature under atmospheric pressure. The ejected wet starch is rapidly exposed to room temperature and atmospheric pressure conditions from high temperature and high pressure conditions, whereby water readily evaporates and the starch bursts and is pulverized to give fine crosslinked starch. Particles of the crosslinked starch finely pulverized from its wet state by the above bursting treatment are obtained in the form of secondary particles that are aggregates of primary particles. Each surface of the primary particles is highly active and converted to α-starch and has high affinity to water, and the above particles of the crosslinked starch can be easily swollen in water, so that they are remarkably industrially advantageous.

In this invention, the starting starch as a raw material before the swelling control and fine pulverization is not specially limited, and any one of generally used starches can be used. Examples thereof include tapioca starch, sago starch, sweet potato starch, rice starch, wheat starch, cornstarch, waxy cornstarch, etc. Further, the starting starch can be also selected from chemically processed starches obtained by chemically or enzymatically modifying these starches, such as oxidized, esterified, etherified or acid-treated starches, etc. Further, these starches may be used in combination of two or more of them.

In this invention, the pigment for use in the intermediate layer is not specially limited, and general inorganic pigments, organic pigments and organic-inorganic composite pigments can be used. The size of the pigment preferably does not exceed approximately 50 μm in view of printed image quality. The pigment includes those that are generally used in coated paper, etc., such as diatomite, talc, kaolin, calcined kaolin, heavy calcium carbonate, precipitated calcium carbonate, magnesium carbonate, zinc oxide, aluminum oxide, aluminum hydroxide, magnesium hydroxide, titanium dioxide, barium sulfate, zinc sulfate, amorphous silica, calcium silicate, colloidal silica, a melamine resin, a urea-formaldehyde resin, polyethylene, polystyrene, ethylene-vinyl acetate, etc. These may be used singly or in combination of two or more of them.

Of these pigments, inorganic pigments having a high oil absorption property are particularly preferably used. An oil-absorbing inorganic pigment refers to an inorganic pigment having an oil absorption of 50 ml/100 g or more according to a JIS K-5101 method, and it includes, for example, calcined kaolin and amorphous silica. When these oil-absorbing pigments and the swellable starch as an adhesive are used, the strength of the intermediate layer can be efficiently maintained without filling up pores of the oil-absorbing pigments, and there can be attained more excellent thermal response, printed image quality and head-matching property that are object of this invention.

Further, when a hollow or cup-shaped heat-insulating organic pigment is used as a pigment, the thermal response can be further improved while maintaining head-matching property. That is, the hollow or cup-shaped heat-insulating organic pigment has high heat-insulating capability due to its form, while it is inferior to an oil-absorbing inorganic pigment in the property of absorbing head deposit. However, when the swellable starch in this invention is used, voids can be formed in the intermediate layer owing to its swelling and shrinking effect, and the property of absorbing head deposit can be imparted. Further, since the heat insulation property is improved, the thermal response can be improved. The hollow organic pigment includes fine hollow particles obtained by expanding thermally expandable microcapsules under heat (e.g., JP59-5093A), and non-expanded fine hollow particles obtained by heating capsules containing water therein to evaporate water and substituting the water by air (e.g., JP62-5886). The cup-shaped organic pigment refers to an organic pigment having a cup-shaped opening portion obtained by partially cutting spherical hollow polymer particles (e.g., JP10-217628A).

The swellable starch and the pigment in this invention are dispersed in a dispersing medium composed of water as a main component together with an adhesive and a dispersing medium such that the content of the swellable starch based on the solid content of the intermediate layer is 5 to 70 mass %, preferably 10 to 50 mass % and that the content of the pigment based on the solid content of the intermediate layer is 30 to 95 mass %, preferably 50 to 90 mass %, and the resultant dispersion is applied to a support so as to attain a dry solid content of 1 to 50 g/m$^2$. When the content of the swellable starch is less than 5 mass %, no sufficient voids can be obtained, and there is produced no effect on any one of thermal response and head-matching property. Further, when it is larger than 70 mass %, undesirably, a coated surface is roughened to make the heat insulation property non-uniform, and the printed image quality is degrade. Further, when the content of the pigment is smaller than 30 mass %, the heat insulation property is insufficient and the thermal response is degraded. When it is larger than 95 mass %, undesirably, a coated surface is roughened or the strength of the intermediate layer is decreased.

As an adhesive for the intermediate layer in this invention, the processed finely pulverized starch in this invention can be used, and it can be also used in combination with other adhesive. The adhesive for use in combination includes water-soluble resins such as starches, hydroxymethyl cellulose, methyl cellulose, ethyl cellulose, carboxymethyl cellulose, gelatin, casein, polyvinyl alcohol, modified polyvinyl alcohol, sodium alginate, polyvinyl pyrrolidone, polyacrylamide, an acrylamide/acrylic ester copolymer, an acrylamide/acrylic ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer, an alkali salt of isobutylene/maleic anhydride copolymer, etc., and water-dispersible resins such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic ester copolymer, an ethylene/vinyl acetate copolymer, polyacrylic ester, a styrene/acrylic ester copolymer, polyurethane, etc., while the above adhesive shall not be limited to these.

The coating liquid for the intermediate layer may contain other additives such as a pigment dispersing medium, a fluorescent dye, a colored dye or pigment, an ultraviolet absorbent, an electrically conductive substance, a lubricant, a water resistant additive, a defoaming agent, an antiseptic agent, etc., so long as the effect of this invention is not impaired.

The support can be selected from paper, various non-woven fabrics, woven fabrics, a plastic film of polyethylene terephthalate or polypropylene, laminated papers obtained by laminating synthetic resins such as polyethylene, polypropylene, etc., synthetic paper, a metal foil of aluminum, glass, etc., and composite sheets obtained by combining these as required depending upon a purpose. The method of applying the intermediate layer onto the support is not specially limited except that it uses a coating liquid composed of water as a main component, and it can be carried out according to a well known conventional technique. For example, there can be used application apparatuses such as an air knife coater, various blade coaters, various bar coaters, various curtain coaters, a film press, etc., or various printing methods such as lithography, letter press, intaglio, flexography, gravure printing, screen printing, etc.

The thermal recording layer that thermally develops a color in this invention is obtained by applying onto the intermediate layer thermal recording components that thermally develop a color. The thermal recording components are not specially limited, and there can be used any combination that causes a color reaction by an applied energy with a thermal head. Examples thereof include a combination of a colorless or light-colored electron-donating dye precursor with an electron-accepting compound, a combination of an aromatic isocyanate compound with an imino compound, a combination of a colorless or light-colored electron-donating dye precursor with an isocyanate compound, a combination of a metal compound with a coordination compound, a combination of diazonium salt with a coupler, and the like. From the viewpoint of a color density, easier color development, easier color development control, etc., there are preferably used a combination of a generally colorless or light-colored electron-donating dye precursor with an electron-accepting compound, a combination of an aromatic isocyanate compound with an imino compound, and a combination of a generally colorless or light-colored electron-donating dye precursor with an isocyanate compound.

The colorless or light-colored electron-donating dye precursor that is used in this invention is not specially limited so long as it is a known substance that is generally used for a pressure-sensitive paper, a thermal recording paper, etc. Specific examples thereof are as follows.

(1) Triarylmethane Compounds:

3,3-bis(p-dimethylaminophenyl)-6-dimethylamino-phthalide (crystal violet lactone), 3,3-bis(p-dimethylaminophenyl) phthalide, 3-(p-dimethylaminophenyl)phthalide, 3-(p-dimethylaminophenyl)-3-(1,2-dimethylindol-3-yl) phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-(p-dimethylaminophenyl)-3-(1-methylpyrrol-2-yl)-6-dimethylamino-phthalide, 3,3-bis(1-n-butyl-2-methylindol-3-yl)phthalide, etc.

(2) Diphenylmethane Compounds:

4,4'-bisdimethylaminobenzhydrinbenzyl ether, N-halophenyl leucoauramine, N-2,4,5-trichlorophenyl leucoauramine, etc.

(3) Xanthene Compounds:

rhodamine B anilinolactam, rhodamine B-p-chloroanilinolactam, 3-diethylamino-7-dibenzylaminofluorane, 3-diethylamino-7-octylaminofluorane, 3-diethylamino-6-chloro-7-methyl, 3-diethylamino-7-(3,4-dichloroanilino)fluorane, 3-diethylamino-7-(2-chloroanilino)fluorane, 3-diethylamino-6-methyl-7-anilinofluorane, 3-dibutylamino-6-methyl-7-anilinofluorane, 3-dipentylamino-6-methyl-7-anilinofluorane, 3-(N-ethyl-N-tolyl)amino-6-methyl-7-anilinofluorane, 3-poperidino-6-methyl-7-anilinofluorane, 3-(N-ethyl-N-tolyl)amino-6-methyl-7-phenetylfluorane, 3-diethylamino-7-chlorofluorane, 3-diethylamino-7-bromofluorane, 3-diethylamino-7-phenoxyfluorane, 3-diethylamino-7-phenylfluorane, 3-dietmylamino-7-(4-nitroanilino)fluorane, 3-diethylamino-7-methyl-7-(3-methylphenylamino)fluorane, 3-(N-methyl-N-propyl) amino-6-methyl-7-anilinofluorane, 3-(N-ethyl-N-isoamyl) amino-6-methyl-7-anilinofluorane, 3-(N-methyl-N-cyclohexyl)amino-6-methyl-7-anilinofluorane, 3-(N-ethyl-N-tetrahydrofurfuryl)amino-6-methyl-7-anilinofluorane, etc.

(4) Thiazine Compounds:

benzoyl leucomethylene blue, p-nitrobenzoyl leucomethylene blue. etc.

(5) Spiro Compounds:

3-methyl-spiro-dinaphthopyran, 3-ethyl-spiro-dinaphthopyran, 3,3'-dichloro-spiro-dinaphthopyran, 3-benzylspiro-dinaphthopyran, 3-methylnaphtho-(3-methoxybenzo)-spiropyran, 3-propyl-spiro-dibenzopyran, etc.

Otherwise, various mixtures of the above compounds can be employed. These will be determined depending upon use fields and desired properties. From the viewpoint of thermal response, particularly preferred for use are 3-dibutylamino- 6-methyl-7-anilinofluorane, 3-dipentylamino-6-methyl-7-anilinofluorane, 3-(N-ethyl-N-isoamyl)amino-6-methyl-7-anilinofluorane, 3-diethylamino-6-methyl-7-(3-methylphenylamino)fluorane and 3-(N-ethyl-N-tolyl)amino-6-methyl-7-anilinofluorane.

Otherwise, various mixtures of the above compounds can be employed. These will be determined depending upon use fields and desired properties.

Examples of the above electron-accepting compounds include clay substances, phenol derivatives, aromatic carboxylic acid derivatives, N,N'-diallylthiourea derivatives, urea derivatives such as N-sulfonylurea, metal salts of these, etc. Specific examples thereof include clay substances such as acid clay, activated clay, zeolite, bentonite, kaolin, etc., p-phenylphenol, p-hydroxyacetophenone, 4-hydroxy-4'-isopropoxydiphenyl sulfone, 4-hydroxy-4'-propoxydiphenyl sulfone, 3-phenylsulfonyl-4-hydroxydiphenyl sulfone, 3-phenylsulfonyl-4-hydroxydiphenyl sulfone, 4-hydroxy-4'-benzenesulfonyloxydiphenyl sulfone, 1,1-bis(4-hydroxyphenyl) propane, 1,1-bis(4-hydroxyphenyl)pentane, 1,1-bis(4-hydroxyphenyl)hexane, 1,1-bis(4-hydroxyphenyl) cyclohexane, 1,1-bis(4-hydroxyphenyl)cyclododecane, 2,2-bis(4-hydroxyphenyl) propane, 2,2-bis(4-hydroxyphenyl) hexane, 2,2-bis(4-hydroxyphenyl)octane, 1,1-bis(4-hydroxyphenyl)-2-ethylhexane, 2,2-bis(3-chloro-4-hydroxyphenyl)propane, 1,1-bis(4-hydroxyphenyl)-1-phenylethane, 1,3-bis[2-(4-hydroxyphenyl)-2-propyl] benzene, 1,3-bis[2-(3,4-dihydroxyphenyl)-2-propyl] benzene, 1,4-bis[2-(4-hydroxyphenyl)-2-propyl]benzene, 4,4'-dihydroxydiphenyl ether, bis[4-(4-toluenesulfonyl)aminocarbonylaminophenyl]methane, N-(2-hydroxyphenyl) benzenesulfoneamide, N-(2-hydroxyphenyl)-p-toluenesulfoneamide, N-(4-hydroxyphenyl)benzenesulfoneamide, N-(4-hydroxyphenyl)-p-toluenesulfoneamide, 4,4'-dihydroxydiphenyl sulfone, 2,4'-dihydroxydiphenyl sulfone, 3,3'-dichloro-4,4'-dihydroxydiphenyl sulfone, 3,3'-diallyl-4,4'-dihydroxydiphenylsulfone, 4-hydroxy-4'-allyloxydiphenyl sulfone, 4-hydroxy-4'-methyldiphenylsulfone, N-p-toluenesulfonyl-N'-3-(-toluenesulfonyloxy)phenylurea, N-(4-hydroxyphenylsulfonyl)aniline, 3,3'-dichloro-4,4'-dihydroxydiphenyl sulfide, methyl 2,2-bis(4-hydroxyphenyl)acetate, butyl 2,2-bis(4-hydroxyphenyl)acetate, 4,4'-thiobis(2-t-butyl-5-methylphenol), benzyl p-hydroxybenzoate, chlorobenzyl p-hydroxybenzoate, dimethyl 4-hydroxypthalate, benzyl gallate, stearyl gallate, salicylanilide, 5-chlorosalicylanilide, a novolak phenolic resin, a modified terpene phenolic resin, 3,5-di-t-butylsalicylic acid, 3,5-di-t-nonylsalicylic acid, 3,5-didodecylsalicylic acid, 3-methyl-5-t-dodecylsalicylic acid, 5-cyclohexylsalicylic acid, 3,5-bis(α,α-dimethylbenzyl)salicylic acid, 3-methyl-5-(α-methylbenzyl)salicylic acid, 4-n-octyloxycarbonylaminosalicylic acid, etc., and metal salts such as zinc, nickel, aluminum and potassium salts of these. However, they shall not be limited to these, and these may be used in combination of two or more of them as required.

The aromatic isocyanate compound is an aromatic isocyanate compound or heterocyclic isocyanate compound that is a solid at room temperature and that is colorless or slightly colored. Specific examples thereof include 2,6-dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4'-diisocyanate, diphenyl ether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethylbiphenyl-4,4'-diisocyanate, 3,3'-dimethoxy-4,4'-diisocyanate, diphenylmethane-4,4'-diisocyanate, diphenyldimethylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate, 4,4',4"-triisocyanate-2,5-dimethoxytriphenylamine, p-dimethylaminophenyl isocyanate, tris(4-phenylisocyanate)thiophosphate, etc. The aromatic isocyanate compound in this invention shall not be limited to these. Further, these compounds may be used singly or in combination of two or more of them as required.

The above isocyanate compounds may be used in the form of so-called blocked isocyanates as required, which are adducts with phenols, lactams or oximes. For example, the isocyanate compound may be used in the form of a dimer of diisocyanate such as 1-methylbenzene-2,4-diisocyanate or a trimer thereof such as iscyanurate. Further, it may be also used in the form of a polyisocyanate which is an addition product with a polyol.

The imino compound is a solid at room temperature and colorless or slightly colored. Specific examples thereof include 3-imino-4,5,6,7-tetrachloroisoindolin-1-one, 1,3-diimino-4,5,6,7-tetrachloroisoindoline, 1,3-diiminoisoindoline, 1,3-diiminobenz(f)isoindoline, 1,3-diiminonaphtho(2,3-f)isoindoline, 1,3-diimino-5-(1H-1,2,3-triazol-1-yl)-isoindoline, 5-(p-t-butylphenoxy)-1,3-diiminoisoindoline, 5-(p-cumylphenoxy)-1,3-diiminoisoindoline, 5-isobutoxy-1,3-diiminoisoindoline, 1,3-diimino-4,7-dimethoxyisoindoline, 4,7-diethoxy-1,3-diiminoisoindoline, 4,5,6,7-tetrabromo-1,3-diiminoisoindoline, 4,5,6,7-tetrafluoro-1,3-diiminoisoindoline, 4,5,7-trichloro-1,3-diimino-6-methylmercaptoisoindoline, 1-iminodiphenic acid imide, 1-(cyano-p-nitrophenylmethylene)-3-iminoisoindoline, 1-(cyanobenzothiazolyl-(2')-carbamoyl-methylene)-3-iminoisoindoline, 1-[(cyanobenzimidazolyl-2')methylene]-3-iminoisoindoline, 1-[(cyanobenzimidazolyl-2')methylene]-3-imino-4,5,6,7-tetrachloroisoindoline, 1-[(cyanobenzimidazolyl-2') methylene]-3-imino-5-methoxyisoindoline, 1-[(1'-phenyl-3'-methyl-5-oxo)-pyrozolidene-4']-3-iminoisoindoline, 3-imino-1-sulfobenzoic acid imide, 3-imino-1-sulfo-4,5,5,6-tetrachloro-enzoic acid imide, 3-imino-1-sulfo-4,5,7-trichloro-6-methylmercaptobenzoic acid imide, 3-imino-2-methyl-4,5,6,7-tetrachloroisoindolin-1-one, etc. The imino compound in this invention shall not be limited to these. These compounds may be used singly or in combination of two or more of them as required.

The thermal recording layer may contain a heat-fusible material (sensitizer) for improving its thermal response. In this case, the heat-fusible material preferably has a melting point of 60 to 180° C., more preferably, a melting point of 80 to 140° C. Specific examples thereof include fatty acid amides such as stearic acid amide, N-hydroxymethylstearic acid amide, N-stearylstearic acid amide, ethylenebisstearic acid amide, oleic acid amide, palmitic acid amide, methylenebis hydrogenated tallow fatty acid amide, ricinoleic acid amide, etc., synthetic and natural waxes such as paraffin wax, microcrystalline wax, polyethylene wax, carnauba wax, etc., aliphatic urea compounds such as N-stearylurea, ether compounds such as benzyl-2-naphthyl ether, α,α-diphenoxyxylyene, bis(4-methoxyphenyl)ether, 2,2'-bis(4-methoxyphenoxy)diethyl ether, 1,2-bis(3-methylphenoxy)ethane, a naphthyl ether derivative, an anthryl ether derivative, aliphatic ether, etc., ester compounds such as diphenyl adipate, bis(4-methylbenzyl) oxalate, dibenzyl oxalate, bis(4-chlorobenzyl) oxalate, diphenyl carbonate, dimethyl terephthalate, dibenzyl terephthalate, phenyl benzenesulfonate, 4-acetylacetophenone, etc., biphenyl derivatives such as m-terphenyl, 4-benzylbiphenyl, 4-allyloxybiphenyl, and known heat-fusible compounds such as bis(4-allyloxyphenyl)sulfone, acetoacetic acid anilides, fatty acid anilides, etc. These compounds may be used singly or in combination of a plurality of them. For obtaining sufficient thermal response, the content of the heat-fusible material in the thermal color-developing layer is preferably 20 to 400 mass %, particularly preferably 50 to 200 mass %, based on the leuco dye.

Examples of the adhesive for the thermal recording layer include water-soluble resins such as non-modified polyvinyl alcohol having a saponification degree of 95% or more, silanol-modified polyvinyl alcohol, epoxy-modified polyvinyl alcohol, acetoacetyl-modified polyvinyl alcohol, carboxy-modified polyvinyl alcohol, acrylic acid amide/acrylonitrile-modified polyvinyl alcohol, hydroxymethyl cellulose, methyl cellulose, ethyl cellulose, carboxymethyl cellulose, gelatin, casein, sodium alginate, polyvinyl pyrrolidone, polyacrylamide, an acrylamide/acrylic ester copolymer, an acrylamide/acrylic ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer, an alkali salt of isobutylene/maleic anhydride copolymer, etc., and water-dispersible resins such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic ester copolymer, an ethylene/vinyl acetate copolymer, polyacrylic ester, a styrene/acrylic ester copolymer, polyurethane, etc. These may be used singly or in combination of a plurality of them.

Further, the thermal recording layer may contain pigments that are generally used in coated paper, etc., such as diatomite, talc, kaolin, calcined kaolin, heavy calcium carbonate, precipitated calcium carbonate, magnesium carbonate, zinc oxide, aluminum oxide, aluminum hydroxide, magnesium hydroxide, titanium dioxide, barium sulfate, zinc sulfate, amorphous silica, calcium silicate, colloidal silica, a melamine resin, a urea-formaldehyde resin, polyethylene, polystyrene, ethylene-vinyl acetate, etc.

In addition thereto, the thermal recording layer may contain higher fatty acid metal salts such as zinc stearate, calcium stearate, etc., higher fatty acid amides such as stearic acid amide, lubricants such as paraffin wax, polyethylene wax, polyethylene oxide, castor wax, etc., benzophenone- and benzotriazole-based ultraviolet absorbents, anionic and nonionic surfactants containing those having high molecular weights, a fluorescent dye, a defoaming agent, etc., as required.

The application amount for the thermal recording layer, generally as an application amount of the dye precursor, is properly 0.1 to 2.0 g/m$^2$. When the above amount is less than 0.1 g/m$^2$, no sufficient recording density can be obtained. When it exceeds 2.0 g/m$^2$, no further improvement in color development and thermal response is observed, and it is economically disadvantageous.

In the thermal recording material of this invention, a protective layer may be formed on the thermal color-developing layer for improving the chemical durability of a recording portion or improving the running property for recording. The above protective layer is formed by applying onto the thermal color-developing layer a protective layer coating liquid containing a resin component as a main component and containing an ultraviolet absorbent and an auxiliary that can be added to the thermal color-developing layer as required so as to obtain an application amount, after drying, of approximately 0.2 to 10 g/m$^2$, preferably 0.5 to 5 g/m$^2$, and drying an applied coating liquid. The protective layer may be single layered or multiple layered.

A pigment is incorporated into the protective layer for improving the running property for recording. The pigment can be selected from diatomite, talc, kaolin, calcined kaolin, calcium carbonate heavy, precipitated calcium carbonate, magnesium carbonate, zinc oxide, aluminum oxide, aluminum hydroxide, magnesium hydroxide, titanium dioxide, barium sulfate, zinc sulfate, amorphous silica, calcium silicate, colloidal silica, a melamine resin, a urea-formaldehyde resin, polyethylene, polystyrene, ethylene-vinyl acetate, etc. Preferably, the protective layer contains at least one of aluminum hydroxide, amorphous silica and colloidal silica. The average particle diameter of the pigment is preferably 3 μm or less. When it is larger than 3 μm, the surface smoothness of the thermal recording material is impaired, and hence a high-precision printed image quality can be no longer obtained.

The adhesive for the protective layer is selected from conventionally known water-soluble or water-dispersible resins as required. Examples thereof include water-soluble resins such as non-modified polyvinyl alcohol having a saponification degree of 95% or more, silanol-modified polyvinyl alcohol, epoxy-modified polyvinyl alcohol, acetoacetyl-modified polyvinyl alcohol, carboxy-modified polyvinyl alcohol, acrylic acid amide/acrylonitrile-modified polyvinyl alcohol, hydroxymethyl cellulose, methyl cellulose, ethyl cellulose, carboxymethyl cellulose, gelatin, casein, sodium alginate, polyvinyl pyrrolidone, polyacrylamide, an acrylamide/acrylic ester copolymer, an acrylamide/acrylic ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer, an alkali salt of isobutylene/maleic anhydride copolymer, etc., and water-dispersible resins such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic ester copolymer, an ethylene/vinyl acetate copolymer, polyacrylic ester, a styrene/acrylic ester copolymer, polyurethane, etc. These may be used singly or in combination of a plurality of them.

Besides these, the protective layer may contain various film-curing agents and crosslinking agents for imparting water resistance and may further contain an ultraviolet absorbent, etc., as required.

In this invention, application methods for the thermal recording layer and the protective layer are not specially limited, and there can be employed, for example, application apparatuses such as an air knife coater, various bladed coaters, various bar coaters, various curtain coaters, film press, etc., or various printing methods such as lithography, letter press, intaglio, flexography, gravure printing, screen printing, etc.

EXAMPLES

This invention will be explained with reference to Examples hereinafter, while this invention shall not at all be limited by these Examples. In Examples, % and part are all based on a mass.

Preparation Example 1

8 Parts of sodium sulfate and 100 parts of tapioca starch were added to 100 parts of water and fully stirred. The resultant starch slurry was adjusted to a pH of 11 with a 3% sodium hydroxide aqueous solution, and 0.3 part of sodium trimetaphosphate was added. The resultant mixture was allowed to react at 40° C. for 8 hours, and then the reaction mixture was neutralized with hydrochloric acid, washed with water and dried to give a crosslinked starch. Further, this crosslinked starch was dry-pulverized with a ball mill, 10 parts of the pulverized crosslinked starch was dispersed in 100 parts of water, and the dispersion was heated at 80° C. for 30 minutes and cooled to room temperature. Then, the dispersion was filtered through a mesh having openings of 100 μm each, and the thus-obtained filtrate was dried to give a swellable starch 1.

Preparation Example 2

A swellable starch 2 was prepared in the same manner as in Preparation Example 1 except that the amount of sodium trimetaphosphate was changed from 0.3 part to 6 parts.

Preparation Example 3

A swellable starch 3 was prepared in the same manner as in Preparation Example 1 except that the mesh having openings of 100 μm each was replaced with mesh having openings of 200 μm each.

Table 1 shows swelling degrees and volume average particle diameters in swollen state of the swellable starches 1 to 3 and a swellable starch 4 (F6493, supplied by Emsland Staerk GmbH).

TABLE 1

| | Swelling degree | Volume average particle diameter in swollen state |
|---|---|---|
| Swellable starch 1 | 8.5 | 32 μm |
| Swellable starch 2 | 1.2 | 17 μm |
| Swellable starch 3 | 8.2 | 110 μm |
| Swellable starch 4 | 7.5 | 20 μm |

Example 1

(1) Preparation of Support with Intermediate Layer Applied Thereon

15 Parts of the swellable starch 4 was dispersed in 200 parts of water, and the obtained dispersion was heated at 80° C. for 30 minutes and cooled to room temperature to give 215 parts of a starch liquid. 30 Parts of a 50% styrene/butadiene copolymer latex, 70 parts of heavy calcium carbonate (SOFTON 1500, supplied by SHIRAISHI CALCIUM KAISHA LTD., oil absorption of 29 ml/100 g) and 100 parts of water were added thereto and fully stirred, and then the resultant coating liquid was applied to woodfree paper having a basis weight of 50 g/m$^2$ so as to obtain a solid coating amount of 5 g/m$^2$ and dried to give a support with an intermediate layer applied thereon.

(2) Preparation of Thermal Recording Layer Coating Liquid

The following mixed solutions (A), (B) and (C) were pulverized with DYNO-MILL (sand mill supplied by WEB) each to obtain a volume average particle diameter of 2 μm or less each, whereby dispersions were prepared.

(A) Dye Dispersion

| | |
|---|---|
| 3-Dibutylamino-6-methyl-7-anilinofluorane | 30 parts |
| 2.5% Polyvinyl alcohol aqueous solution | 70 parts |

(B) Electron-Accepting Compound Dispersion

| | |
|---|---|
| 4-Hydroxy-4'-isopropoxydiphenyl sulfone | 30 parts |
| 2.5% Polyvinyl alcohol aqueous solution | 70 parts |

(C) Pigment-Sensitizer Dispersion

| | |
|---|---|
| Calcium carbonate (CALRITE SA: supplied by SHIRAISHI CALCIUM KAISHA LTD.) | 50 parts |
| Benzyl-2-naphthyl ether | 30 parts |
| 2.5% Polyvinyl alcohol aqueous solution | 200 parts |

The dispersions (A), (B) and (C) and the following other materials were mixed, and the mixture was stirred to prepare a thermal recording layer coating liquid.

| | |
|---|---|
| (A) Dye dispersion | 100 parts |
| (B) Electron-accepting compound dispersion | 100 parts |
| (C) Pigment-sensitizer dispersion | 280 parts |
| 40% Zinc stearate aqueous dispersion | 25 parts |
| 40% Methylol stearic acid amide aqueous dispersion | 25 parts |
| 20% Paraffin wax aqueous dispersion | 25 parts |
| 10% Polyvinyl alcohol aqueous solution | 200 parts |
| 10% Dimethylolurea aqueous solution | 10 parts |
| Water | 100 parts |

(3) Production of Thermal Recording Material

The thermal recording layer coating liquid prepared in (2) was applied on the surface of the support with the intermediate layer applied thereon prepared in (1) so as to obtain a solid application amount of 5 g/m$^2$, and the applied coating liquid was dried to form a thermal recording layer. The thermal recording layer was super-calendered so as to attain a BEKK smoothness of 400 to 500 seconds, whereby a thermal recording material was produced.

Example 2

A thermal recording material was produced in the same manner as in Example 1 except that the heavy calcium carbonate in (1) Preparation of support with intermediate layer applied thereon in Example 1 was replaced with calcined kaolin (Norcal, supplied by Nord Kaolin Company, oil absorption of 114 ml/100 g).

Example 3

A thermal recording material was produced in the same manner as in Example 1 except that 70 parts of the heavy calcium carbonate in (1) Preparation of support with intermediate layer applied thereon in Example 1 was replaced with 70 parts, as a solid, of a hollow organic pigment (Ropaque HP-91, supplied by Rohm & Hass Company).

Example 4

A thermal recording material was produced in the same manner as in Example 1 except that the swellable starch 4 in (1) the preparation of the support with the intermediate layer applied thereon in Example 1 was replaced with the swellable starch 1.

Example 5

A thermal recording material was produced in the same manner as in Example 1 except that the swellable starch 4 in (1) the preparation of the support with the intermediate layer applied thereon in Example 1 was replaced with the swellable starch 2.

Example 6

A thermal recording material was produced in the same manner as in Example 1 except that the swellable starch 4 in (1) the preparation of the support with the intermediate layer applied thereon in Example 1 was replaced with the swellable starch 3.

Example 7

A thermal recording material was produced in the same manner as in Example 1 except that the 3-dibutylamino-6-methyl-7-anilinofluorane in (A) Dye dispersion of (2) Preparation of Thermal Recording Layer Coating Liquid in Example 1 was replaced with 3-diethylamino-6-methyl-7-anilinofluorane and further that the heavy calcium carbonate in (1) the preparation of the support with the intermediate layer applied thereon was replaced with calcined kaolin (Norcal, supplied by Nord Kaolin Company, oil absorption of 114 ml/100 g).

Comparative Example 1

A thermal recording material was produced in the same manner as in Example 1 except that the swellable starch 4 in (1) Preparation of the support with the intermediate layer applied thereon in Example 1 was replaced with oxidized starch (EmoxTSC, supplied by Emsland Staerk GmbH).

Comparative Example 2

A thermal recording material was produced in the same manner as in Example 1 except that the heavy calcium carbonate in (1) the preparation of the support with the intermediate layer applied thereon was replaced with calcined kaolin (Norcal, supplied by Nord Kaolin Company, oil absorption of 114 ml/100 g) and further that the swellable starch 4 was replaced with oxidized starch (EmoxTSC, supplied by Emsland Staerk GmbH).

Comparative Example 3

A thermal recording material was produced in the same manner as in Example 1 except that 70 parts of the heavy calcium carbonate in (1) the preparation of the support with the intermediate layer applied thereon in Example 1 was replaced with 70 parts, as a solid, of a hollow organic pigment (Ropaque HP-91, supplied by Rohm & Hass Company) and further that the swellable starch 4 was replaced with oxidized starch (EmoxTSC, supplied by Emsland Staerk GmbH).

Comparative Example 4

A thermal recording material was produced in the same manner as in Example 1 except that 70 parts of the heavy calcium carbonate was not added in (1) the preparation of the support with the intermediate layer applied thereon in Example 1.

Test 1: Thermal Response Test

Characters were printed on each of the thermal recording materials of Examples 1 to 7 and Comparative Examples 1 to 4 with a facsimile tester TH-PMD supplied by Ohkura Electric Co., Ltd. A thermal head having a dot density of 8 dots/mm and a head resistance of 1,685Ω was used, and the characters were printed at an applied voltage of 21 V and an applied pulse width of 0.6 msec or 1.0 msec. Each printed image was measured with a Macbeth RD-918 reflectance densitometer (visual filter).

Test 2: Evaluation for Head Deposit Adherence

A built-in test chart was continuously printed on each of the thermal recording materials of Examples 1 to 7 and Comparative Examples 1 to 4 with a thermal printer DPU-5300 supplied by Seiko Instruments Inc., continuously for 10 minutes, and a printed chart quality and a state of adherence of deposit to a thermal head were visually evaluated.

TABLE 2

| | Starch | Pigment | Thermal response test [msec] 0.6 | 1.0 | Evaluation for head deposit |
|---|---|---|---|---|---|
| Ex. 1 | Swellable starch 4 | heavy Calcium carbonate | Δ | ○ | ○ |
| Ex. 2 | Swellable starch 4 | Calcined kaolin | ○ | ◎ | ◎ |
| Ex. 3 | Swellable starch 4 | Hollow organic pigment | ◎ | ◎ | ○ |
| Ex. 4 | Swellable starch 1 | heavy Calcium carbonate | Δ | ○ | ○ |
| Ex. 5 | Swellable starch 2 | heavy Calcium carbonate | Δ | Δ | Δ |
| Ex. 6 | Swellable starch 3 | heavy Calcium carbonate | Δ | ○ | ○ |
| Ex. 7 | Swellable starch 4 | Calcined kaolin | Δ | ◎ | ◎ |
| CEx. 1 | Oxidized Starch | heavy Calcium carbonate | X | Δ | X |
| CEx. 2 | Oxidized Starch | Calcined kaolin | Δ | Δ | ○ |
| CEx. 3 | Oxidized Starch | Hollow organic pigment | ○ | ◎ | X |
| CEx. 4 | Swellable starch 4 | Nil | X | X | X |

Ex. = Example,
CEx. = Comparative Example

In data of the thermal response test in Table 2, ◎ shows a print density of 1.2 or more, ○ shows a print density of 1.0 or more but less than 1.2, Δ shows a print density of 0.5 or more but less than 1.0, and X shows a print density of less than 0.5. Further, in data of evaluation for head deposit in Table 2, ◎ shows a state of almost no deposit adhering, ○ shows a state of slight deposit adhering but having no influence on a printed image quality, Δ shows a state of deposit adhering to some degree and causing little thinner spots to some extent, and X shows a state of deposit adhering to a very great extent and causing very poor printed image quality.

Figure 2:
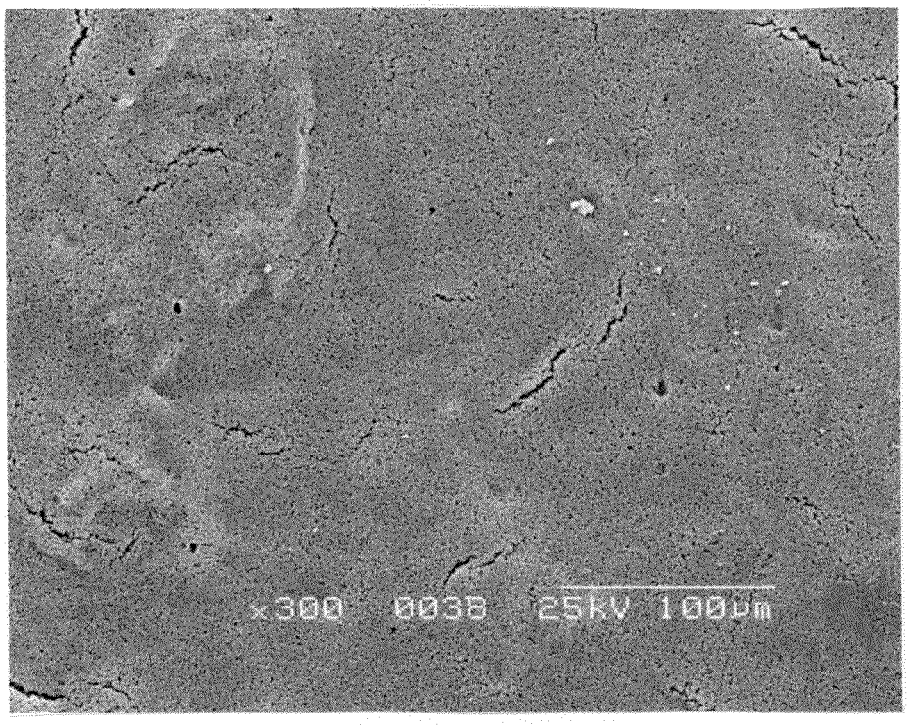
FIG. 2 is an electron microscope photograph of the surface of an intermediate layer in Comparative Example 3.

Surfaces of supports with intermediate layers applied thereon after (1) Preparation of support with intermediate layer applied thereon but before the application of thermal recording layers were observed at a magnification of 300 diameters through a scanning electron microscope S-2300 supplied by Hitachi, Ltd. FIGS. 1 and 2 show images of these.

As is clear from Table 2, when the swellable starches 1 to 4 were incorporated into the intermediate layers in Examples 1 to 7, there were obtained thermal recording materials that had high color developed densities in printed images and had less adherence of deposit to a head and that were excellent in head-matching property. Of these, Example 2 is a thermal recording material excellent in particular in head-matching property, and Example 3 is a thermal recording material excellent in particular in thermal response.

In Examples 1 to 3, the coloring sensitivity and the property of absorbing a head deposit are clearly improved as compared with those in Comparative Examples 1 to 3 using usual oxidized starch in their intermediate layers. In Example 2 in which calcined kaolin as an oil-absorbing inorganic pigment is incorporated into the intermediate layer, the property of heat insulation is imparted while the property of the pigment absorbing a head deposit is improved, so that the thermal response and head-matching property are improved as compared with those in Comparative Example 2. In Example 3 in which a hollow organic pigment is incorporated into the intermediate layer, a number of voids are formed in the intermediate layer as shown in FIG. 1 and the property of absorbing head deposit while the property of heat insulation is proved, so that a high thermal response and high head-matching property are materialized as compared with those in Comparative Example 3.

INDUSTRIAL UTILITY

In a thermal recording material having an intermediate layer and a thermal recording layer that are laminated on a support in this order, the above intermediate layer contains a swellable starch and a pigment and is formed by applying a coating liquid containing the swellable starch and the pigment in the state of being dispersed in a dispersing medium composed of water as a main component onto the support, whereby a number of voids are formed in the intermediate layer and there can be provided a thermal recording material excellent in thermal response and head-matching property.

The invention claimed is:

1. A thermal recording material having an intermediate layer and a thermal recording layer that are laminated on a support in this order, wherein the above intermediate layer is a layer obtained by applying onto the support a coating liquid containing a swellable starch and a pigment in the state of being dispersed in a dispersing medium composed of water as a main component and drying an applied coating liquid, wherein the intermediate layer has voids formed by the shrinking of the swellable starch from its swollen state in the process of drying after application and said intermediate layer contains a heat-insulating organic pigment that is in the form of hollow or cup-shaped particles.

2. The thermal recording material of claim 1, wherein said swellable starch has its swelling degree controlled by a crosslinked structure.

3. The thermal recording material of claim 2, wherein said swellable starch has a swelling degree of 2 or more.

4. The thermal recording material of claim 2, wherein said swellable starch has a volume average particle diameter of 100 μm or less in a state of its being swollen in water.

5. The thermal recording material of claim 2, wherein said intermediate layer contains an oil-absorbing inorganic pigment.

6. The thermal recording material of claim 2, wherein said thermal recording layer contains at least one compound selected from 3-dibutylamino-6-methyl-7-anilinofluorane, 3-dipentylamino-6-methyl-7-anilinofluorane, 3-(N-ethyl-N-isoamyl)amino-6-methyl-7-anilinofluorane, 3-diethylamino-6-methyl-7-(3-methylphenylamino)fluorane and 3-(N-ethyl-N-tolyl)amino-6-methyl-7-anilinofluorane.

7. The thermal recording material of claim 1, wherein said swellable starch has a swelling degree of 2 or more.

8. The thermal recording material of claim 7, wherein said swellable starch has a volume average particle diameter of 100 μm or less in a state of its being swollen in water.

9. The thermal recording material of claim 7, wherein said intermediate layer contains an oil-absorbing inorganic pigment.

10. The thermal recording material of claim 7, wherein said thermal recording layer contains at least one compound selected from 3-dibutylamino-6-methyl-7-anilinofluorane, 3-dipentylamino-6-methyl-7-anilinofluorane, 3-(N-ethyl-N-isoamyl)amino-6-methy-7-anilinofluorane, 3-diethylamino-6-methyl-7-(3-methylphenylamino)fluorane and 3-(N-ethyl-N-tolyl)amino-6-methyl-7-anilinofluorane.

11. The thermal recording material of claim 1, wherein said swellable starch has a volume average particle diameter of 100 μm or less in a state of its being swollen in water.

12. The thermal recording material of claim 11, wherein said intermediate layer contains an oil-absorbing inorganic pigment.

13. The thermal recording material of claim 11, wherein said thermal recording layer contains at least one compound selected from 3-dibutylamino-6-methyl-7-anilinofluorane, 3-dipentylamino-6-methyl-7-anilinofluorane, 3-(N-ethyl-N-isoamyl)amino-6-methyl-7-anilinofluorane, 3-diethylamino-6-methyl-7-(3-methylphenylamino)fluorane and 3-(N-ethyl-N-tolyl)amino-6-methyl-7-anilinofluorane.

14. The thermal recording material of claim 1, wherein said intermediate layer contains an oil-absorbing inorganic pigment.

15. The thermal recording material of claim 14, wherein said thermal recording layer contains at least one compound selected from 3-dibutylamino-6-methyl-7-anilinofluorane, 3-dipentylamino-6-methyl-7-anilinofluorane, 3-(N-ethyl-N-isoamyl)amino-6-methyl-7-anilinofluorane, 3-diethylamino-6-methyl-7-(3-methylphenyl)amino)fluorane and 3-(N-ethyl-N-tolyl)amino-6-methyl-7-anilinofluorane.

16. The thermal recording material of claim 1, wherein said thermal recording layer contains at least one compound selected from 3-dibutylamino-6-methyl-7-anilinofluorane, 3-dipentylamino-6-methyl-7-anilinofluorane, 3-(N-ethyl-N-isoamyl)amino-6-methyl-7-anilinofluorane, 3-diethylamino-6-methyl-7-(3-methylphenylamino)fluorane and 3-(N-ethyl-N-tolyl)amino-6-methyl-7-anilinofluorane.

* * * * *